US006398478B2

(12) United States Patent
Smith et al.

(10) Patent No.: US 6,398,478 B2
(45) Date of Patent: Jun. 4, 2002

(54) COMPACTION MECHANISM FOR REFUSE AND RECYCLABLES COLLECTION VEHICLES

(75) Inventors: Fred P. Smith; Fred T. Smith, both of Alpine, UT (US)

(73) Assignee: Wayne Engineering Corporation, Cedar Falls, IA (US)

( * ) Notice: Subject to any disclaimer, the term of this patent is extended or adjusted under 35 U.S.C. 154(b) by 0 days.

(21) Appl. No.: 09/789,206

(22) Filed: Feb. 20, 2001

Related U.S. Application Data

(62) Division of application No. 09/079,597, filed on May 16, 1998, now Pat. No. 6,234,739.
(60) Provisional application No. 60/046,753, filed on May 16, 1997.

(51) Int. Cl.[7] ..... B65F 3/20
(52) U.S. Cl. ..... 414/525.51; 414/525.3
(58) Field of Search ..... 414/525.3, 525.4, 414/525.5, 525.21, 525.52, 525.53, 525.54, 525.55

(56) References Cited

U.S. PATENT DOCUMENTS

| | | | |
|---|---|---|---|
| 2,748,964 | A | 6/1956 | Murphy |
| 3,233,760 | A | 2/1966 | Herpich et al. |
| 3,653,522 | A | 4/1972 | Gollnick |
| 3,696,951 | A | 10/1972 | Toppins et al. |
| 3,881,613 | A | 5/1975 | Torimoto et al. |
| 3,929,243 | A | 12/1975 | Smith |
| 3,940,006 | A | 2/1976 | Smith |
| 3,994,406 | A | 11/1976 | Smith |
| 3,999,669 | A | 12/1976 | Smith |
| 4,042,134 | A | 8/1977 | Smith |
| 4,065,008 | A | 12/1977 | Ratledge |
| 4,460,307 | A | 7/1984 | Durant et al. |
| 4,863,336 | A | 9/1989 | Gasparini |
| 4,954,020 | A | 9/1990 | Smith |
| 5,015,144 | A | 5/1991 | Smith |
| 5,123,801 | A | 6/1992 | O'Daniel |
| 5,478,188 | A | 12/1995 | Rea et al. |

*Primary Examiner*—James W. Keenan
(74) *Attorney, Agent, or Firm*—Husch & Eppenberger, LLC; Robert E. Muir

(57) ABSTRACT

A compaction mechanism for mounting to a storage body for refuse or recyclables includes a tailgate apparatus mountable to a rearward opening of the storage body. The tailgate apparatus includes a receiving hopper and a movable panel which in a compaction position provides a rear closure for the storage body. The moveable panel is pivotally mounted to a pair of side panels which are pivotable upon the rear end of the sides of the tailgate. The movable panel may be swept rearwardly while the side panels are pivotable to a high position and then after the side panels are lowered, the moveable panel is pivoted forwardly to sweep through the hopper and compact the swept articles into the opening of the storage body. The entire tailgate may be opened by operation of a cylinder and link mechanism mounted between the top of the storage body and the rear face of the tailgate.

3 Claims, 9 Drawing Sheets

COMPACTION MECHANISM FOR REFUSE AND RECYCLABLES COLLECTION VEHICLES

CROSS REFERENCE TO RELATED APPLICATION

This application is a division of Application Ser. No. 09/079,597, filed May 16, 1998, and now U.S. Pat. No. 6,234,739. which claims benefit of Prov. No. 60/046,753 filed May 16, 1997.

COPYRIGHT INFORMATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all rights under applicable copyright law.

1. Field of the Invention

The present invention relates generally to waste or recyclables collection systems and assemblies. More particularly, the invention relates to systems and assemblies which pack and then unload the waste or recyclables.

2. Background of the Invention and Prior Art

Refuse collection trucks are generally used for collection of trash and other refuse or recyclables. Typically, a refuse collection truck has a body which is supported by a chassis and wheels and which stores the refuse for transport. Rear loading refuse trucks also include a tailgate assembly mounted at the back-end portion of the truck. This tailgate assembly has a hopper for receiving refuse and an opening between the hopper and the body for transporting the refuse to the body. Typically, the tailgate assembly has a sweeping mechanism for pushing and compacting the refuse in the hopper before the packing mechanism forces the refuse into the body or storage area of the refuse collection truck. The packing and sweeping mechanisms work together as the compactor by forcing the fresh refuse against the old refuse into the body, thereby compacting the refuse within the body to a maximum density.

In general, it is necessary for the packing/sweeping mechanisms of this type of packer to have four travel paths. This is generally accomplished by having a packing panel which is pivotally attached to a carrier panel. The first and second paths accommodate the addition of fresh refuse into the hopper. From a position where the packer blade is holding the refuse in the body, the first path is having the packing blade rotate rearwardly up and over refuse piled in the hopper. This is called the unsweep cycle. The second path moves the carrier panel and packing blade down such that the blade is in a position above and behind the refuse. This is called the unpack cycle. The third part of the path is when the packing panel rotates toward the front of the truck. This is generally called the sweep motion as it sweeps material out of the rear of the hopper toward the front. The fourth portion is called the packing cycle. In this portion, material is moved up from its position in the bottom of the hopper to be packed into the body of the truck.

The object of the first two paths is to get the blade up and over the refuse in such a way as to not push the refuse back into the street and to allow the refuse to be built up as high in the hopper as possible. When the packing/sweeping mechanisms are in the packing mode or have stopped at the end of the packing mode, the packing/sweeping mechanisms are positioned to allow refuse into the hopper without obstruction. As the packing/sweeping mechanisms return to the contain mode, at the end of the pack cycle, they hold the refuse in the body and pack it against old refuse. As more and more material is packed into the body, the ejector panel gradually moves toward the front of the body until the body is full.

The hopper of the tailgate assembly is designed to receive refuse containers of varying sizes which are either hand-load operated or lift-mechanism operated. The hand-loading operation requires a refuse crew to collect the refuse in-hand and put it into the hopper of the refuse collection truck. The lift-mechanism operation uses a device to grab the refuse container, raise the container above the rear opening of the hopper and tilt the container sufficiently to dump all the refuse into the hopper.

The prior art rear loading types of packers that have an upper panel connected to a lower panel use several ways to control the movement of the panels. The first method is to have the upper panel slide in a groove and the lower panel rotates at its end controlled by a hydraulic cylinder connected between the two panels. Another method uses two sets of two forward projecting links connected at one of their ends to the tailgate and connected at their other ends to the upper panel. A typical representation of this method is shown in U.S. Pat. No. 3,999,669. This four-bar mechanism controls the motion of the upper panel. The lower panel rotates at its end controlled by a hydraulic cylinder connected between the two panels. Yet another method uses two sets of two rearward facing links connected at one of their ends to the tailgate and connected at their other ends to the upper panel. This four-bar mechanism controls the motion of the upper panel. The cylinder that controls the lower panel is connected between the tailgate and the lower panel. A representative example of this is shown in U.S. Pat. No. 5,478,188. Yet another method used to control the panels is to rotatably connect the upper panel to the tailgate on a single axis such that it can swing. The prior art attached the cylinder for moving the lower panel between the tailgate and the lower panel. A representative example of this is shown in U.S. Pat. No. 4,460,307.

The efficiency of a packer is based on the amount of refuse the packer can pack in what amount of time. Therefore, the swept volume and the cycle time are integral parts of the equation and should be optimized. The number of cycles or frequency of operation of the packing/sweeping mechanisms depends upon the capacity of the hopper. A large hopper can temporarily store a larger volume of refuse and accordingly, less time is lost while waiting for the packing/sweeping mechanisms to complete their cycle. The height of the sill at the tailgate opening is one factor that limits hopper capacity. The higher the refuse receiving opening is above the ground, the more effort is required by the workmen in dumping their containers into the hopper. Accordingly, the sill over which the refuse is dumped into the hopper should be as low as possible. In general it is desirable to have as light a collection vehicle as possible. It is desirable to have the overhang past the rear axle as short as possible. It is desirable to have as high a density packing as feasible. It is desirable to have the cycle time as quick as possible, especially the time from packing to being able to reload the hopper. There are also restrictions on height and width that must be maintained. There is also a minimum exit angle from the rear tires to the bottom of the hopper that should be maintained for ground clearance. It is also desirable to have a packer that has low maintenance and is inexpensive to build.

The prior art packers that use a slot to control the motion of the upper panel have the following deficiencies. The straight motion during the pack cycle means that the hopper floor will be flat in that area. Flat floors require additional stiffeners to support the pressure on them, thus increasing the weight of the tailgate. Slides are difficult to seal and therefore are prone to deteriorate more quickly than pivot style of bearings. Slides are also more difficult to support structurally than a single pivot, thus requiring more material and weight to do so. Also, the straight path during the packing cycle limits the hopper capacity somewhat. The blade tip must travel from the lowest point at the end of the sweep up to the hopper lip. If this path is curved there is more usable hopper volume than if it is straight.

The prior art that utilizes forward facing links has the following deficiencies. The amount of bearings to make this work is large. This again makes support of the bearings more difficult, adding weight. More bearings result in more maintenance problems. This method also has a hopper that has a major change of direction between the sweep and pack cycles. This wears the hopper out more quickly. This discontinuity also causes more problems with moving incompressible objects into the body and fall back is a greater problem. This prior art also uses a packing cylinder in the pull mode verses the push mode. This means that it does not make as good use of the available force as possible.

The prior art that utilizes rearward facing links has the following deficiencies. The amount of bearings to make this work is large. This again makes support of the bearings more difficult, adding weight. More bearings result in more maintenance problem, not only for the bearings themselves, but for the maintenance of parts they connect. This prior art also uses a packing cylinder in the pull mode verses the push mode. This means that it does not make as good use of the available force as possible.

The prior art that uses a swinging type of attachment for the upper panel is configured such that the motion of the panels on the unpack stroke tend to push material out of the hopper. The packer cylinders are pulling to pack and thus do not have the added force for the same pressure that pushing would give. In addition, high pressure is needed during the sweep and pack cycles. Cylinders that are pulling during the high pressure cycle are more likely to leak hydraulic fluid than those that push. The angle of incidence of the tip of the panel to the hopper is far from 90 degrees. This gives a tendency for the blade to ride up over the material in the hopper giving larger pressures in the cylinders.

Therefore, it would be highly advantageous to remedy the foregoing and other deficiencies inherent in the prior art.

SUMMARY OF THE INVENTION

In order to accomplish the desired objects of the invention with a preferred embodiment thereof, provided is a back-end mounted tailgate assembly with the included packing mechanism and a body with the included ejector system on a refuse collection truck. The tailgate assembly or hopper includes a hopper floor between two side walls. The hopper floor extends below the body floor. This allows the hopper to collect and hold incoming refuse. The upper and lower panels act together to do the packing and sweeping motions. The upper panel consists of a shield supported by a frame that extends between the hopper walls. The frame is rotatably mounted to the tailgate by a pair of upper panel spherical pivots which are located substantially above the hopper sill. The lower packing panel is pivotally connected to the upper panel by a pair of pivots. The lower panel consists of a blade, extended between the two side walls, which sweeps and then packs the refuse or other materials along the hopper floor up into the body. Slits in the side walls provide egress for a beam to which the packer cylinders attach on the outside of the tailgate. This provides the motion to the packer panel assembly.

The sweep cylinders attach between a pair of upper cylinder ears on the upper portion of the upper panel to a pair of ears on the rear portion of the lower panel. This cylinder configuration provides the motion for the lower panel relative to the upper panel.

It is necessary to position the pack cylinders against the exterior portion of the side walls or outside of the hopper in order to have a pack cylinder that pushes. This positioning prevents the pack cylinder from interfering with the intake of refuse.

The tailgate assembly is pivotally attached to the body at the top on each side. The tailgate opening cylinder is pivotally attached to the center of the roof of the body. The rod end of the cylinder is attached to one end of a link. The other end of the link pivots at the top header beam of the tailgate. The rotation of this link also rotates a torque tube that in turn pulls up on a rod and opens the latch at the bottom of the tailgate. This latch fixedly connects the bottom of the tailgate to the body during packing. There is also another link which is rotatably attached to the tailgate rearward of the link pivot. The other end of this link is slotted and is located between the afore mentioned tailgate link pivots. The rod end of the cylinder is also attached to slide within this slot. The motion of the packing mechanism is as follows. The sweep cylinder retracts, rotating the packer blade rearward. With a large rod this can be made to happen very fast. The packer cylinder retracts which rotates both panels and moves the packer blade into a position behind and above the refuse or other material. The sweep cylinder extends. If additional speed is desired, the cylinder can be made to regenerate during the first portion of the sweep and then kick out of regeneration when the higher force is needed. As the sweep cylinder extends, the packing panel rotates forward moving material toward the body opening. The packer cylinder extends, which raises both panels and pushes the refuse or other material into the body under high pressure. The material is pushed against the ejector panel which starts at the rear of the body. This gives a uniformly higher density to the packed refuse. As the pressure builds up, a valve allows the ejector to move forward until the whole body is packed full. To raise the tailgate to allow for dumping, the tailgate cylinder is retracted. The first link and the slotted end of the second link and the rod end of the cylinder rotate upwardly. The rotation of the first link opens the tailgate latches. When the rod end of the cylinder pivoted on the end of the first link reach the end of the slot, the latches have been opened and the cylinder has been raised up high enough to have sufficient moment arm to raise the tailgate. Pulling to raise the tailgate also resolves the problem of cylinder drift opening the tailgate. Most automatic unlatching tailgates use push motion to open and raise the tailgate. When the cylinders and valves wear, they tend to leak and when leakage occurs to a cylinder it generally extends. When this happens the tailgate opens.

With the tailgate opened the ejector panel is extended to the rear of the truck and the material is ejected from the body. The tailgate lift cylinder is extended and the tailgate shuts. When the tailgate is shut all of the way, the cylinder keeps extending which locks the tailgate locks and lowers the overall height of the cylinder.

Accordingly, it is an object of the present invention to provide a new and improved waste or recyclables collection system.

A further object of this invention is to produce a packer that will not push garbage out of the hopper on the return stroke. This is accomplished by having the pivot for the upper panel substantially over the sill of the hopper. This makes the return stroke such that the refuse that has been piled up in the hopper is pushed down against the bottom of the hopper rather than being pushed rearwardly out of the hopper. This also allows the present design to have a deeper hopper.

Another object of the present invention is to decrease cycle times and increase panel pressures by utilizing the inherent push and pull features of the sweep and pack cylinders to best advantage. The largest forces in the entire cycle are during the sweep and pack when refuse is being compacted. During the unsweep and unpack, maximum speed is desired and little force is required. By utilizing a packer cylinder that pushes instead of pulls, a large rod can be used. This gives the aforementioned advantages of a larger packing force for the same pressure and the large rod increases the return speed dramatically. The pack cylinder is also positioned such that the moment arm at the beginning of the pack cycle (when less compaction is needed) is smaller than the moment arm at the end of the pack cycle when maximum compaction is needed. Matching the required force to the actual force in this way also decreases the cycle time.

Another object of the invention is to reduce the weight of the packing mechanism, tailgate and associated parts. The mounting of the cylinder is unique in that it is mounted adjacent to the tailgate lock area. The tailgate lock area must be reinforced to transfer the packing loads into the body. By mounting the packing cylinder to this area which had already been reinforced, the need to reinforce another area was eliminated. Therefore, the overall weight is reduced. Another way weight reduction has been accomplished is in the design of the scraper panel. The scraper panel consists of a beam on the bottom that is pointed that scrapes material off of the upper panel as the packer goes through its motion. There are times when the force on the bottom beam of the scraper panel may be quite substantial. The area above the beam must also be sealed off so that refuse does not flow over the beam back into the tailgate, but instead is pushed into the body. The present invention has a sheet that is curved from side to side, welded to the top of this scraper beam. The sheet being curved holds the pressure against it from the inside of the body without the use of additional stiffeners. This is accomplished because the sheet is put into tension rather than having to take the pressure and bending. The additional benefit to curving the sheet this way is that it keeps the local buckling of the sheet from occurring which would then cause the lower scraper beam to fail.

A further object of the present invention is to be able to accommodate offset packing loads without increasing the weight of the structure. During packing, if the load is not centered in the hopper some of the load from the packer cylinder on the side away from the offset load needs to be transferred to the side where the offset load is. This is accomplished by designing the upper panel such that it can rotate around a substantially horizontal axis. This rotation allows the upper and packing panels to come against the side of the hopper on one side and the upper side of the upper panel comes against the other side of the hopper. This puts a force couple into the whole panel structure that offsets the couple induced by the offset load.

A further object of the present invention is to have less wear on the hopper floor. This is accomplished by three methods. First, as the packer panel goes through the sweep portion it comes to a point where it is almost tangential to the curve of the packer portion of the cycle. This means that the transition between the two is smooth and doesn't put high forces on the hopper floor. Additionally, the packer panel is designed such that the angle of incidence of the tip of the panel against the floor is nearly 90 degrees. This provides more of a scooping action of the refuse going up the hopper than many other designs where the panel is trying to wipe over the refuse. The third method used for reducing the wear of the hopper is that during the packing portion of the cycle, the packer blade actually begins to diverge from the floor. This reduces the pressure on the hopper floor as the pack cycle continues, thus reducing the wear.

An additional object of the present invention is to provide a vertical mounting beam for bin lifters that is not an addition to the structure, thus adding weight.

A further object of the present invention is to produce a swept area that is almost square in cross section. The reason for this is that, for a four sided area, a square gives largest area for the same perimeter. Rounding of the path provides even more efficiency gains. Elongation of the swept cross-sectional area reduces the efficiency.

Another object of the present invention is to have a hopper that is easy to load. The square cross section of the swept volume gives a hopper that is much easier to fully load than any of the designs that have a more elongated swept volume.

Another object of the present invention is to increase the packing efficiency by reducing fall back of the packed material into the hopper. This is accomplished by having a small distance between the upper forward edge of the hopper and the tip of the packing panel. It is also accomplished by having the edge of the hopper lip higher than the floor of the body. This provides a "catch" that holds onto the material and keeps it from falling back into the hopper.

Another object of the present invention is to maximize the number of tailgates that can fit in an overseas shipping container.

Another object of the present invention is to provide a tailgate that will fit various width bodies.

Another object of the present invention is to provide an automatic tailgate latch and opener with few cylinders, that will accommodate different widths and has a low mounting height.

Another object of the present invention is to simplify the hydraulic routing especially for shipping only tailgates. This is accomplished by mounting a single valve block on the tailgate itself.

DESCRIPTION OF THE DRAWING FIGURES

The invention of a rear-loading refuse collection truck can better be understood by referring to the following description and the respective drawings.

FIG. 1 is a rear perspective view of a rear-loading refuse/recyclables collection truck body.

FIG. 2A is a side view of a tailgate assembly with both a sweep cylinder and a pack cylinder fully extended. This is shown with the side removed for clarity. This represents the fully packed-in position of the packer panels.

FIG. 2B is a side view of the tailgate assembly with the sweep cylinder retracted and the pack cylinder still fully extended. This is shown with the side removed for clarity. This is the position of the panels at the end of the upsweep cycle.

FIG. 2C is a side view of the tailgate assembly with the sweep cylinder and the pack cylinder both retracted. This is shown with the side removed for clarity. This shows the position of the panels at the end of the unpack cycle.

FIG. 2D is a side view of the tailgate assembly with the sweep cylinder fully extended again and the pack cylinder retracted. This is shown with the side removed for clarity. This is the position of the panels at the end of the sweep portion of the cycle.

FIG. 3 is a front perspective of the collection truck body showing the ejector panel in its fully retracted position.

FIG. 4A shows a side elevation of the entire collection vehicle. The ejector is fully retracted. A break out allows for showing the positions of the ejector and the packer panels FIG. 4B shows a side elevation of the entire collection vehicle. The tailgate is raised and the ejector has just pushed the load out.

DETAILED DESCRIPTION

Figure 1:
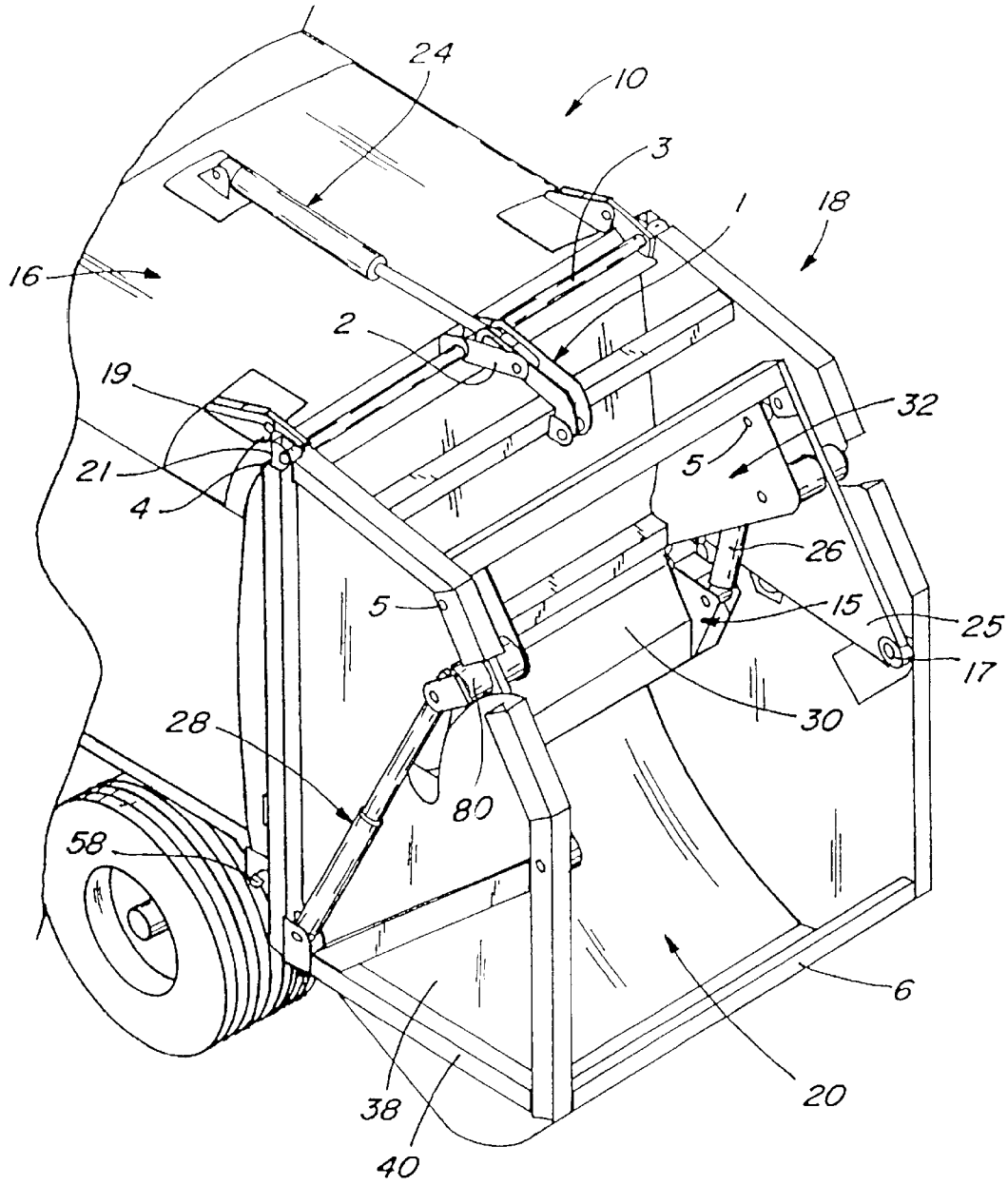
Figure 2B:
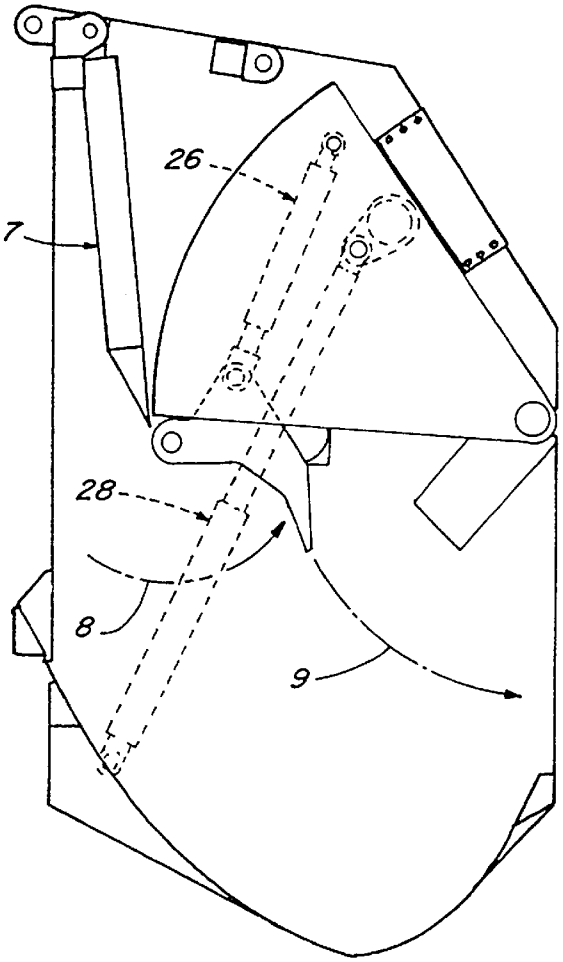
Figure 2A:
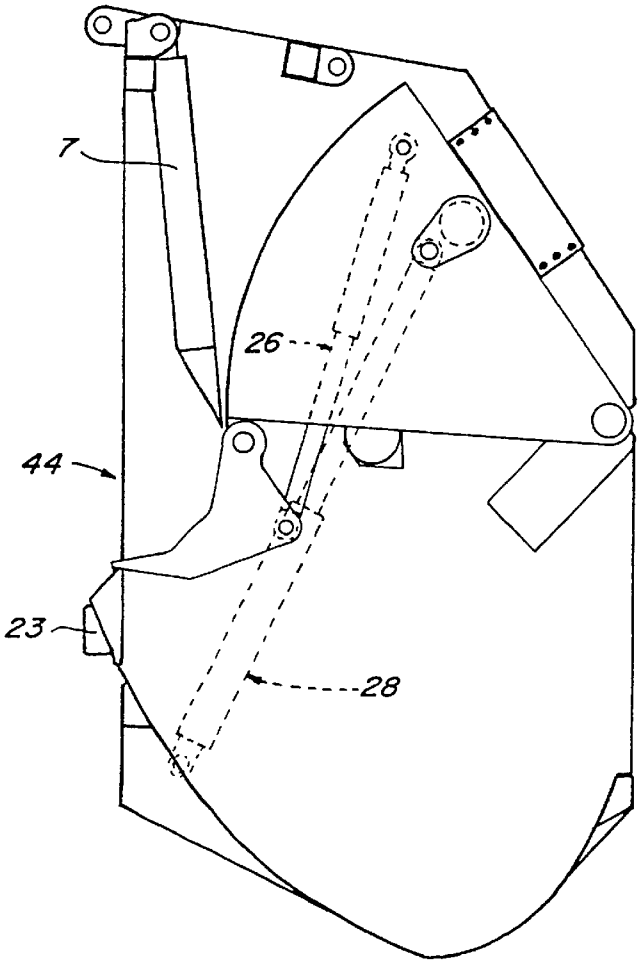

Referring to the drawings, FIG. 1 illustrates a rear-loading refuse collection truck generally indicated at 10 which is equipped with a truck body 16 and a tailgate assembly 18. The tailgate assembly 18, is positioned at the rear end of the refuse collection truck 10. With the ejector panel 22 pushed all of the way to the rear of the truck body 16 and the sweep cylinders 26 and the packer cylinders 28 fully extended a full loading cycle will be explained. This is the position of the panels in FIG. 2A.

Figure 2D:
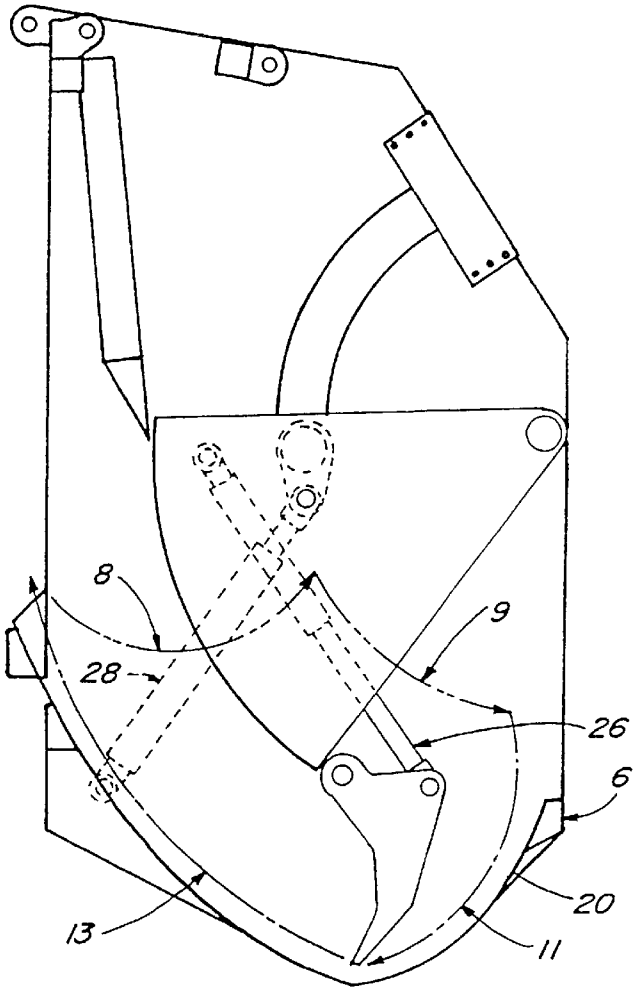
Figure 2C:
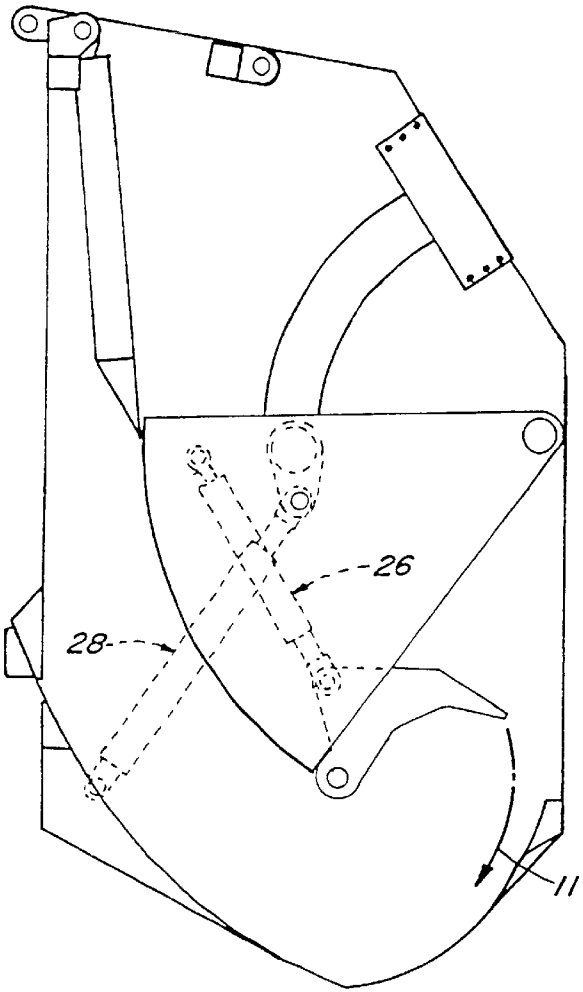
Figure 3:
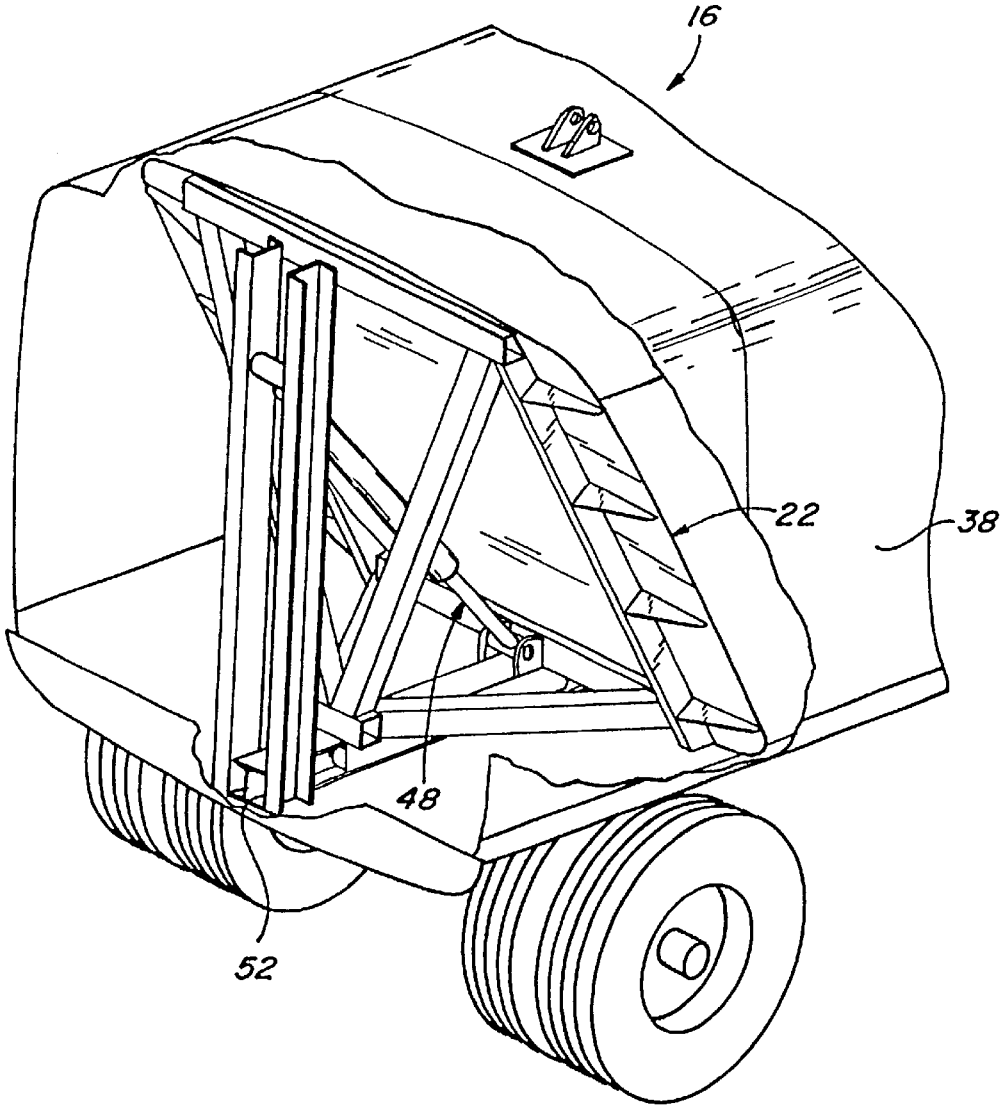

Refuse or other material 14 is loaded into or unloaded (see FIG. 4B) from the hopper 20 through the rear. The term "refuse" as used herein is intended to be generic of any collected materials including recyclables. When the hopper is full, a valve is actuated which sends fluid to the rod end of the sweep cylinders 26, each of which are located adjacent to the hopper walls 38. The hopper walls 38 are supported in part by a base tube 40. The bore end of the sweep cylinder 26 is connected to the upper panel 32 by cylinder pin 5. As best shown in FIG. 2C, a slot in the hopper walls 28 enables the ends of the cylinders 28 and 26 to move relative to the slot by means of a beam 80. A packer assembly is generally designated as 44 in FIG. 2A. The rod end is connected to the packer panel 30 at the packer panel ears 15. This rotates the packer panel 30 rearwardly such that the tip of the packer panel 30 follows unsweep path 8. The valving can then either manually or automatically shift such that fluid is sent to the rod end of the pack cylinders 28. Both the upper panel 32 and the packer panel 30 rotate about the panel pivot 17. The tip of the packer panel 30 will follow the unpack path 9. Because the panel pivot 17 is located almost directly over the hopper sill 6, the path of the tip of the blade is still moving in a downward direction and is almost perpendicular to the upper edge of the hopper 20. This means that refuse 14 that is displaced by the motion of the packer panel during the unpack cycle is compressed down into the back of the hopper 20 rather than being pushed out the rear of the hopper 20. Another advantage of having the panel pivot 17, which is connected to a side member 25, in this position is that the sweep cylinder 26 can be mounted between the upper panel 32 and the lower panel 30. This makes manufacturing much easier and does not require that the sweep cylinder 26 have spherical bearings to take the twist during an offset load condition. The cycle can be stopped at this point as required in the United States for safety with the tip of the packer blade 30 within the required distance from the hopper sill 6.

The operator actuates a valve and fluid flows to the head end of the sweep cylinders 26 causing them to extend. The tip of the packer panel follows the sweep path 11. The smooth transition of the path from sweep to pack allows the hopper 20 to have a smooth transition such that the material is pushed easily along the hopper 20 which also makes less wear on the hopper 20. The valve can then be automatically or manually shifted such that fluid flows into the head end of the packer cylinder 28. As the packer cylinder 28 extends, the tip of the packer panel 30 follows pack path 13. Note that the angle of incidence of the inside tip of the packer panel 30 to the hopper 20 remains approximately 90 degrees throughout the sweep and pack cycles. Pack path 13 diverges from the hopper 20 the further the packer panel 30 gets toward the front. This also reduces wear on the hopper 20. The space between the packer panel 30 and the hopper 20 during the sweep and pack cycles provides additional safety (not as severe a shear point), makes the packer easier to manufacture as the tolerances need not be as close, and does not adversely affect the operation of the packer. As the refuse 14 is pushed along by the packer panel 30, the scraper panel 7 separates the refuse 14 from the upper panel 32 and diverts it into the truck body 16. The material is packed against the ejector panel 22 which is held in place by the ejector track 52 and the ejector cylinder 48. Filling the hopper 20 and repeating the packing cycle is repeated many times. The packer path 8, 9, 11, 13 in FIG. 2D produces an almost square path without the use of complex four-bar mechanisms and all of their associated pivots. This gives the most swept volume for the least amount of packer movement.

As the initial void between the ejector panel 22 and the scraper panel 7 is filled, the refuse 14 gets packed denser and denser until if something did not happen, the packer blade would simply stop before it got to the end of its stroke. Before this happens the control system senses that the pressure is high and shifts a valve which allows the ejector cylinder 48 to retract and the ejector panel 22 to move forward. This continues until the operator is done for the day or until the ejector has moved as far forward as possible. At this point the operator drives to a landfill, transfer station or incinerator.

Figure 4A:
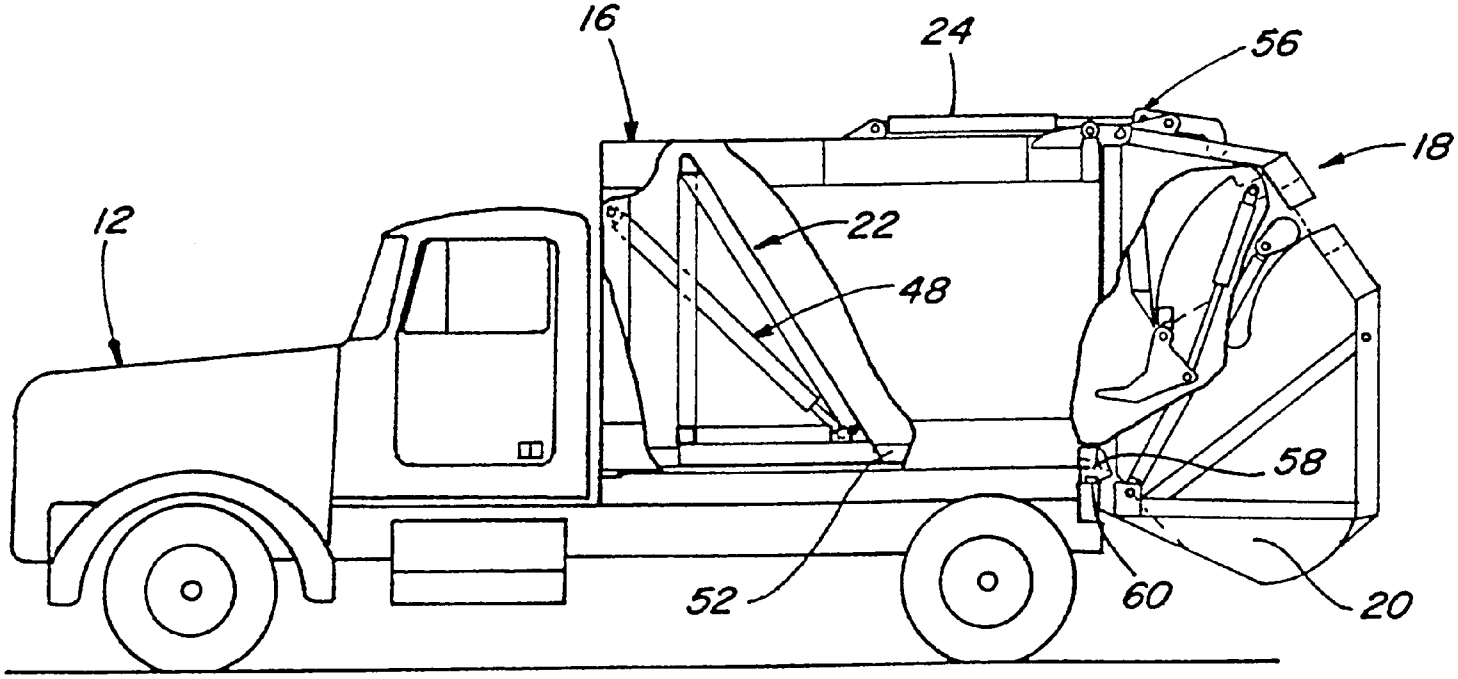
Figure 4B:
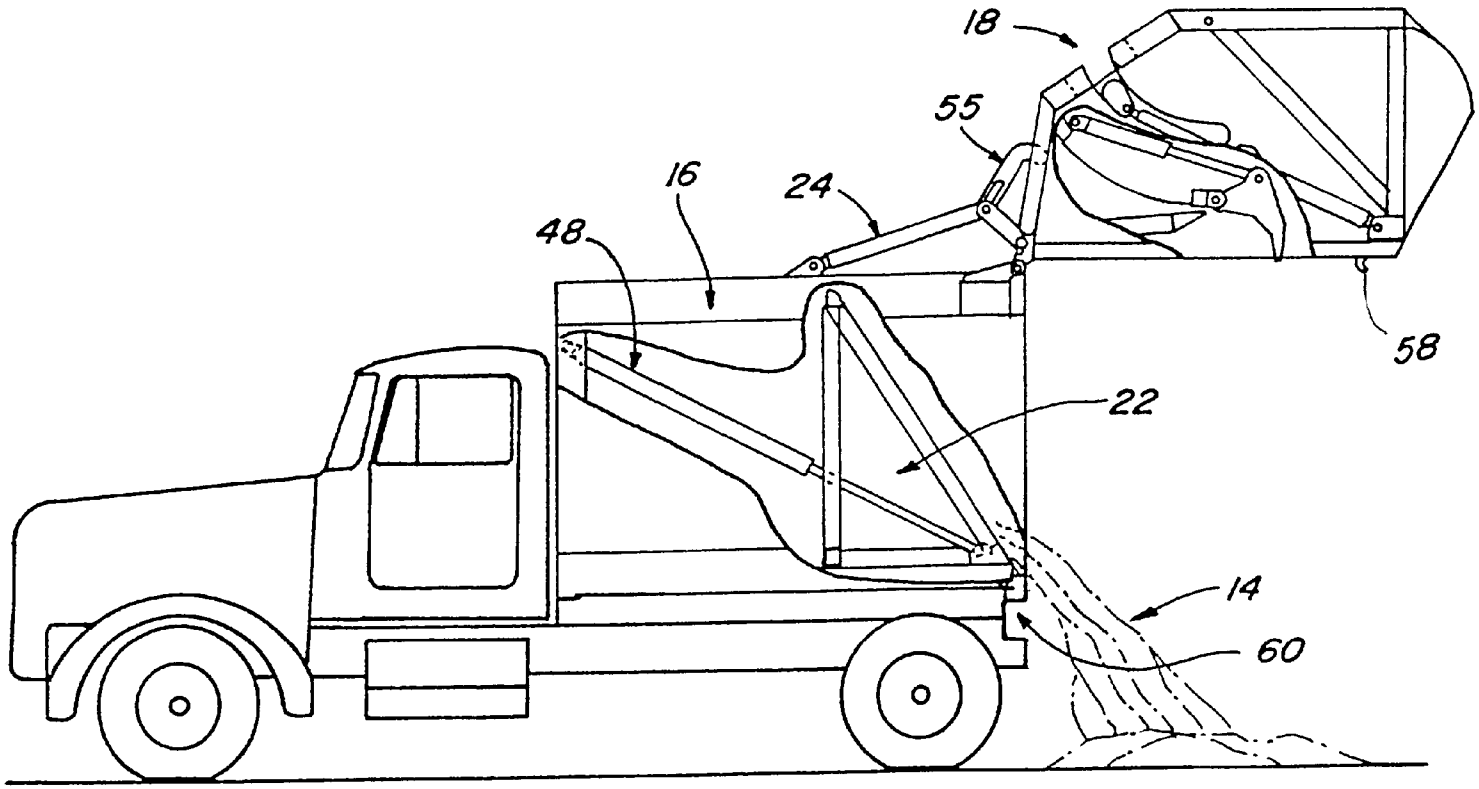

To raise the tailgate 18 to allow for ejecting the refuse 14, the tailgate cylinder 24 is retracted. The lift link 2 which is pivotally attached to the top beam of the tailgate 18 on one end and pivotally attached to the rod end of the tailgate cylinder 24 which is also pivotally attached to the slot in the slotted link 1. As the tailgate cylinder 24 retracts, the rod end of the tailgate cylinder 24 and both links that are attached to it rotate upwardly. The rotation of the lift link 2 rotates the torque tube 3 which rotates ears 21 downward. These, in turn, push down on the latch link 4. The latch link 4 pushes down on the tailgate latch 58 which causes the hooked part of the tailgate latch 58 to move up and away from the hook pin 60 which is fixedly attached to the rear of the truck body 16. This opens the tailgate latches 58. When the rod end of the tailgate cylinder 24 reaches the end of the slot, the latches 58 have been opened and the tailgate cylinder 24 has been raised up high enough to have sufficient moment arm to raise the tailgate 18. This is shown in FIG. 4B.

The operator activates a valve which directs fluid to the head end of the ejector cylinder 48. This causes the cylinder 48 to extend which pushes the ejector panel 22 rearward pushing the refuse 14 out of the truck body 16. The tailgate 18 is then lowered by extending the tailgate cylinder 24 which lowers the tailgate 18 and locks it by reversing the aforementioned unlatching steps.

The tailgate 18 is designed to accept wings on the sides that allow it to fit a wider body. This is another reason for the type of latch and tailgate cylinder used. Thus latch 58 and tailgate raise cylinder 24 do not need to be changed for different width bodies whereas a tailgate that mounts in the side beams between the tailgate frame and the rear frame of the body would need to be modified.

By making the hopper extension 23 removable and restricting the fore-to-aft dimension of the tailgate, the number of trucks 10 that will fit in a shipping container for overseas shipment was maximized. The hopper extension 23 may be attached when the truck 10 reaches its shipping destination. Mounting a valve block on the tailgate also eases the plumbing requirement for tailgates 18 that are shipped overseas.

Figure 5:
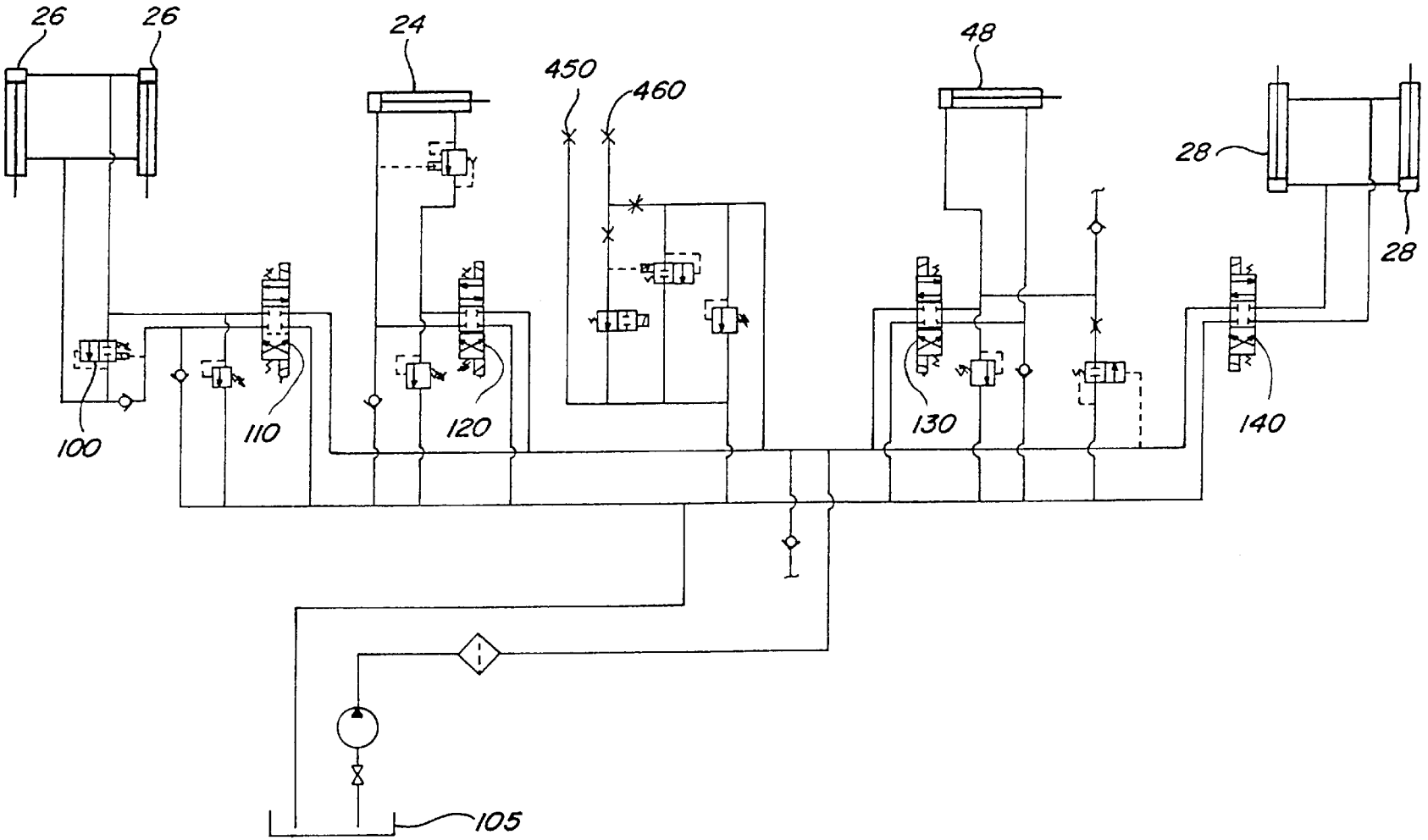
FIG. 5 is a schematic diagram of the hydraulic system used with the rear-loading refuse collection body invention.

FIG. 5 shows a hydraulic system for a preferred embodiment of the present invention. The sweep cylinders 26 are connected to a re-generation valve 100 and a sweep valve 110 which are arranged as shown. The tailgate lift cylinder 24 is connected to a tailgate lift valve 120. The ejector cylinder 48 is connected to an ejector valve 130, and the pack cylinders 28 are connected to a pack valve 140 as shown. An optional portion of this hydraulic circuit includes a bin lift return 450 and a bin lift supply 460. As shown in FIG. 5, all of these hydraulic components are connected to a hydraulic tank 105. Electrical controls for the various valves are described below.

Figure 6A:
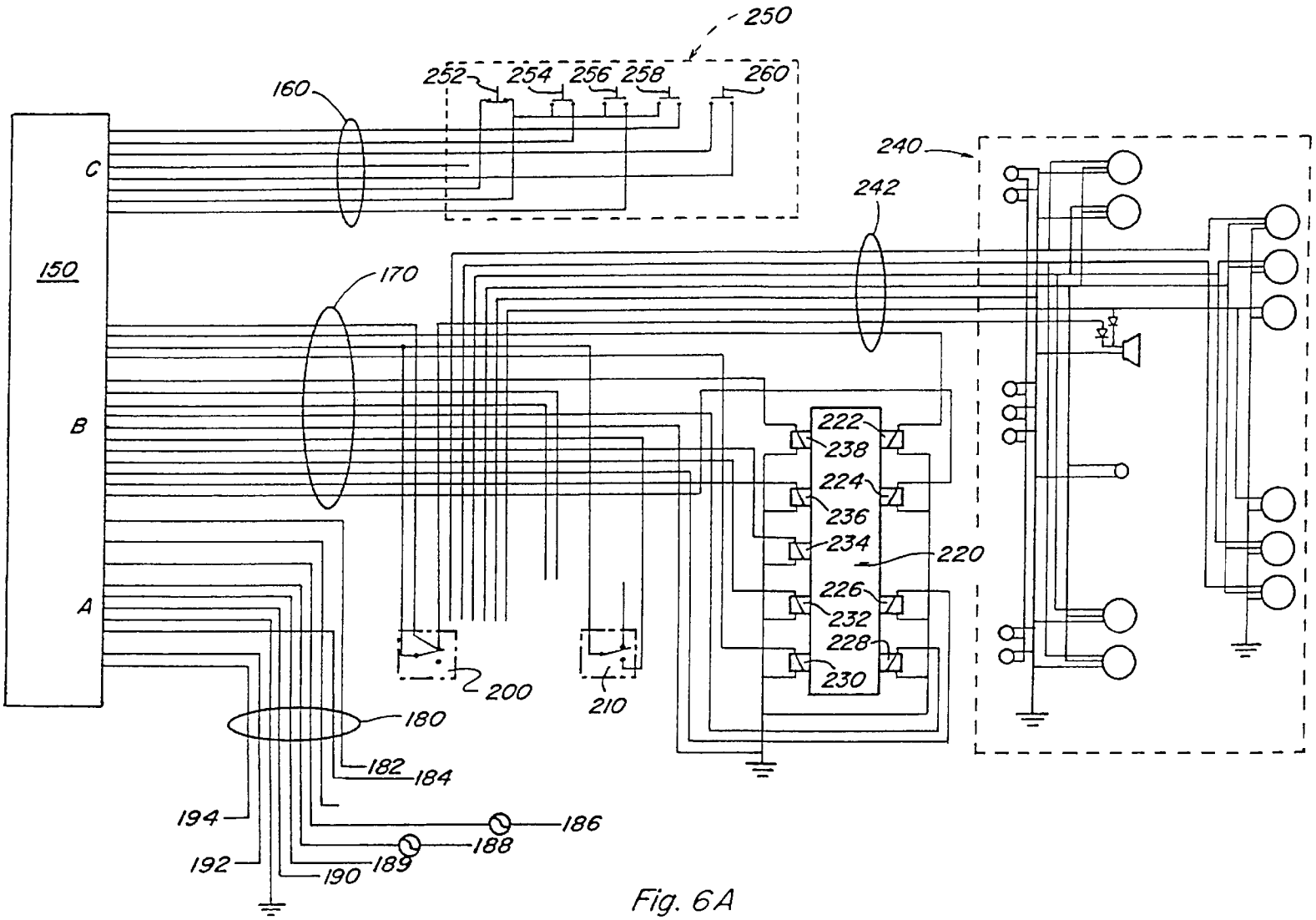
FIGS. 6A and 6B are a schematic diagram of the electrical system used with the rear-loading refuse collection body invention.

FIG. 6A shows part of an electrical system for this preferred embodiment. A control panel is shown at 150, which interconnects the electrical functions. A lighting system 240 is connected through a light harness 242. The lines coming out of the control panel at section C go through a control harness at 160 which follows through to control switches at 250. These switches include an emergency stop switch 252, a driver alert switch 254, an auto unsweep/unpack switch 256, an auto sweep/pack switch 258, and a rescue switch 260.

The lines exiting the control panel 150 at section B go through a valve harness 170 to control the above described hydraulic valves indicated generally by 220. As shown, a sweep control 230 and an unsweep control 228 are for the sweep valve 110, a tailgate lift control 232 and a tailgate lower control 226 are for the tailgate lift valve 120, a loader control 234 is for the optional part of the hydraulic circuit, an ejector control 236 and a retract control 224 are for the ejector valve 130, and a pack control 238 and an unpack control 222 are for the pack valve 140. A tailgate open switch 200 is connected to lines coming from the panel harness 170 as shown. A pressure switch is shown at 210.

The lines exiting the cab control panel at A go through a cab harness 180. As shown these lines travel to an engine at 182, an accelerator at 184, a power-take-off at 185, a 12-volt signal from an ignition at 186, a 12-volt supply from a battery at 188, a first neutral connection at 189, a second neutral connection at 190, a connection to a starter at 192, and a connection from the starter at 194.

Figure 6B:
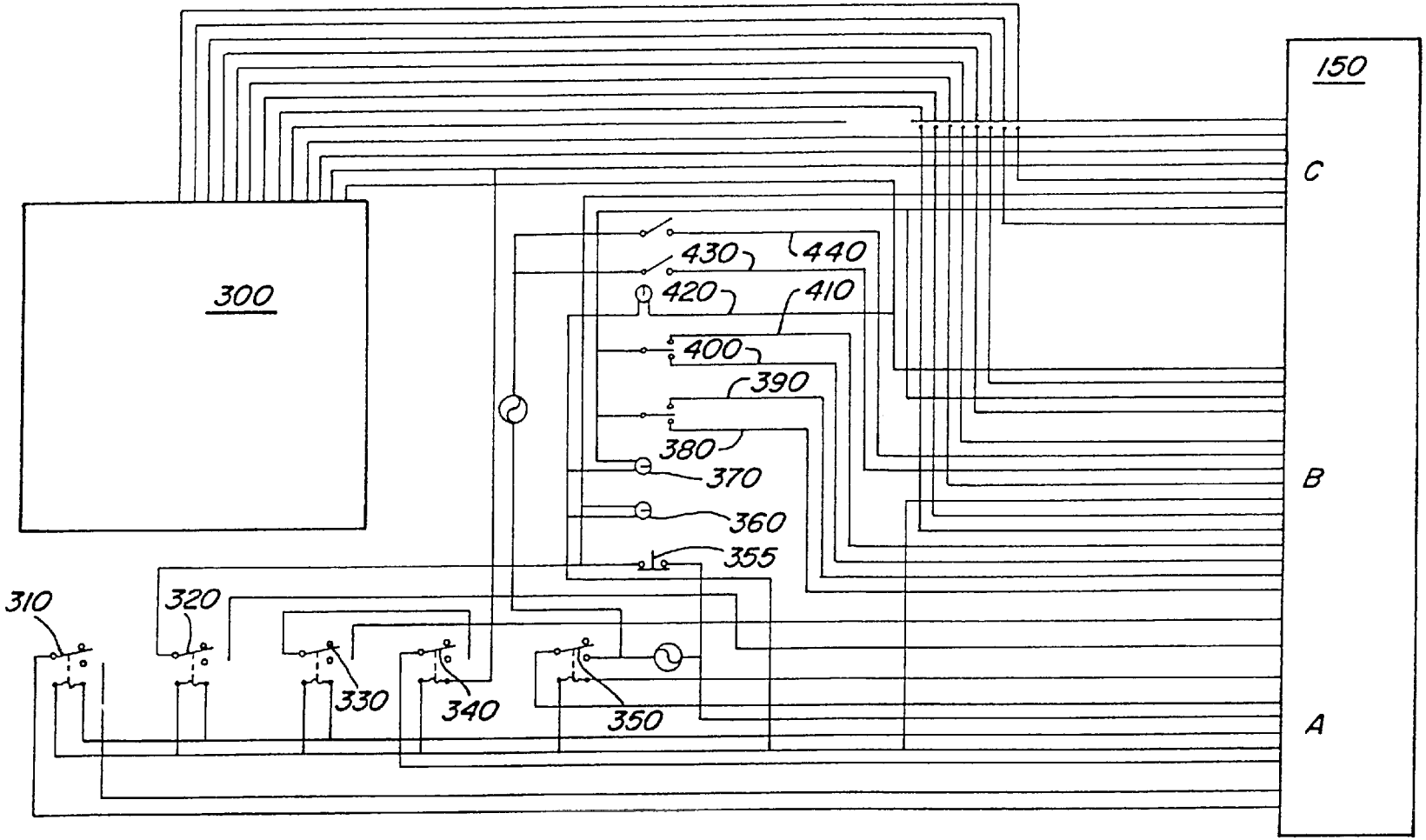

FIG. 6B shows a second portion of the electrical system. All the lines here are connected to the control panel 150 which is shown in both FIGS. 6A and 6B. A control board 300 and several switches are connected to the control panel 150 as shown. The switches include a neutral start switch 310, a neutral pump switch 320, a neutral acceleration switch 330, an acceleration relay switch 340, a power relay switch 350, and an emergency stop switch 355. A "system on" light is shown at 360; and a "tailgate on" light at 370. A retraction switch 380 coordinates with an ejection switch 390. A tailgate lower switch 400 coordinates with a tailgate lift switch 410 and a "tailgate open" light is shown at 420. A strobe light switch is shown at 430 and a work light switch at 440. Other arrangements may be made by those skilled in the art.

What is claimed is:

1. A tailgate apparatus for a refuse collection apparatus, the tailgate apparatus including:

an upper portion, a lower portion, a lower front edge, a rear edge, and lateral sides;

an upper panel extending between the lateral sides and pivotally connected to the lateral sides adjacent the rear edge and pivotable within the upper portion about a fixed pivot axis defined by the pivotal connection;

a packer panel connected to the upper panel; and a pack cylinder having a rod end and another end spaced from the rod end, one of said ends being operatively connected to the upper panel and the other of said ends being connected to the lower portion adjacent the lower front edge, and the pack cylinder being operative for moving said upper panel and said packer panel from a lower position to an upper position to pack the refuse.

2. A tailgate apparatus as set forth in claim 1, including a sweep cylinder with an end connected to the upper panel and another end connected to the packer panel.

3. A tailgate apparatus as set forth in claim 1, including opposite sidewalls, and wherein the pack cylinder is disposed upon an outer side of one of the sidewalls.

* * * * *